US006508422B2

(12) United States Patent
Wickensberg et al.

(10) Patent No.: US 6,508,422 B2
(45) Date of Patent: Jan. 21, 2003

(54) PULPER FOR A FIBER STOCK PREPARATION SYSTEM

(75) Inventors: Steve Wickensberg, Reedsville, WI (US); Mike Van Rossum, Greenleaf, WI (US); Mike Theobald, Appleton, WI (US); Kurt W. Lorenz, Appleton, WI (US); Klaus Doelle, Appleton, WI (US); Oliver U. Heise, Menasha, WI (US)

(73) Assignee: Voith Paper, Inc., Appleton, WI (US)

( * ) Notice: Subject to any disclaimer, the term of this patent is extended or adjusted under 35 U.S.C. 154(b) by 50 days.

(21) Appl. No.: 09/853,305

(22) Filed: May 11, 2001

(65) Prior Publication Data

US 2002/0166910 A1 Nov. 14, 2002

(51) Int. Cl.[7] ..... B02C 23/36

(52) U.S. Cl. ..... 241/46.17

(58) Field of Search ..... 241/46.02, 46.17, 241/285.1

(56) References Cited

U.S. PATENT DOCUMENTS 3,874,600 A * 4/1975 Honeyman et al. ..... 241/46.17
4,607,802 A * 8/1986 Lamort ..... 241/46.17
4,725,007 A * 2/1988 Chupka ..... 241/46.17

* cited by examiner

*Primary Examiner*—Mark Rosenbaum
(74) *Attorney, Agent, or Firm*—Taylor & Aust, P.C.

(57) ABSTRACT

A pulper for pulping a fiber source includes a tank and a rotor. The tank has a plurality of annular-shaped inner walls defining a chamber. The plurality of walls include a first wall, second wall, third wall and forth wall which are sequentially vertically adjoining relative to each other. Each of the walls are disposed at an angle relative to a vertical reference. The first wall is disposed at an angle of between 45 and 70° relative to the vertical reference. The second wall is disposed at an angle of between 20 and 45° relative to the vertical reference. The third wall is disposed generally parallel to the vertical reference. The forth wall is disposed at an angle of between 10 and 30° relative to the vertical reference. The tank further includes two baffles within the chamber which inhibit rotational movement of the fiber source within the chamber.

18 Claims, 3 Drawing Sheets

PULPER FOR A FIBER STOCK PREPARATION SYSTEM

BACKGROUND OF THE INVENTION

1. Field of the Invention

The present invention relates to a pulper in a stock preparation system, and, more particularly, to a pulper providing a high consistency output.

2. Description of the Related Art

A fiber stock preparation system is used to make a fiber suspension from a source of fiber such as wood. The fiber stock preparation system receives the raw source of fiber, breaks the raw source of fiber into individual fibers suspended in a liquid such as water, and separates contaminants from the fiber suspension.

A fiber stock preparation system as described above typically includes a pulper which assists in breaking down the raw source of fiber into individual fibers. A pulper typically includes a rotatable element within a chamber which imparts mechanical forces to the source of fiber and breaks the source of fiber into individual fibers. The pulped fiber is transported downstream to other mechanical devices within the stock preparation system. For example, the pulped fiber may be further processed within a disperger. A disperger receives the pulped fiber and removes contaminants from the fiber suspension and thoroughly mixes chemicals within the fiber suspension.

Pulpers of conventional design as described above effectively pulp the raw source of fiber into individual fibers. However, it may be desirable to provide a higher consistency output from the pulper depending upon the particular application.

What is needed in the art is a pulper which is configured to provide a higher consistency output.

SUMMARY OF THE INVENTION

The present invention provides a pulper in a fiber stock preparation system having a tank with particularly configured inner walls, baffles within the tank, and a particularly configured rotor within the tank which provide a high consistency and high quality output.

The invention comprises, in one form thereof, a pulper for pulping a fiber source including a tank and a rotor. The tank has a plurality of annular-shaped inner walls defining a chamber. The plurality of walls include a first wall, second wall, third wall and forth wall which are sequentially vertically adjoining relative to each other. Each of the walls are disposed at an angle relative to a vertical reference. The first wall is disposed at an angle of between 45 and 70° relative to the vertical reference. The second wall is disposed at an angle of between 20 and 45° relative to the vertical reference. The third wall is disposed generally parallel to the vertical reference. The forth wall is disposed at an angle of between 10 and 30° relative to the vertical reference. The tank further includes two baffles within the chamber which inhibit rotational movement of the fiber source within the chamber.

An advantage of the present invention is that a high consistency and high quality stock is outputted from the pulper.

Another advantage is that the shape of the inner walls, the baffles within the tank, and the configuration of the rotor coact to provide the high consistency output.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
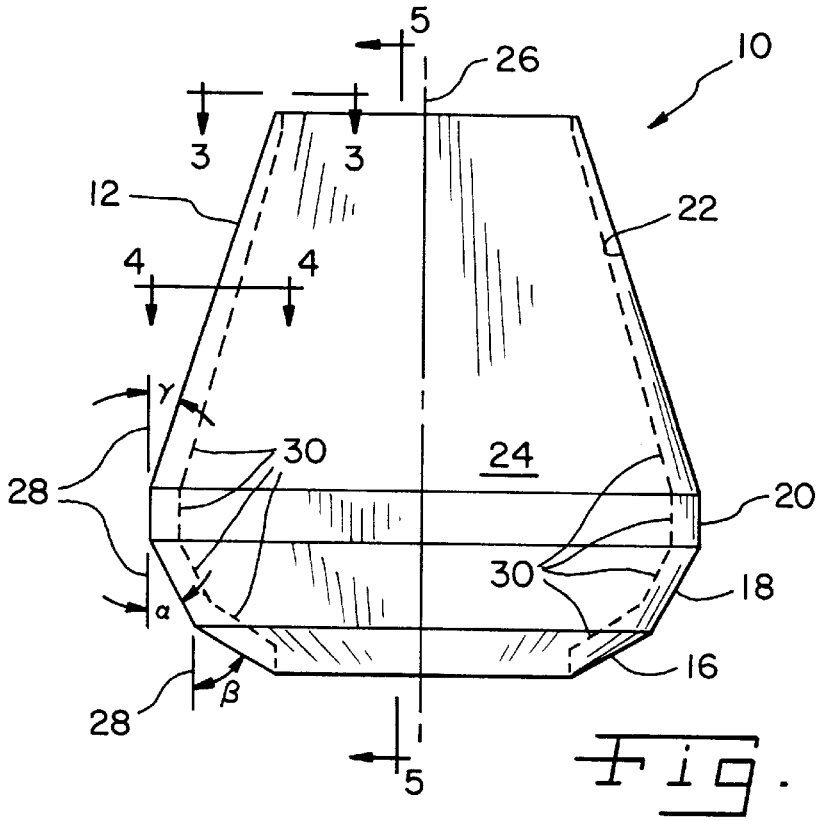
FIG. 1 view of an embodiment of a pulper of the present invention.
Figure 2:
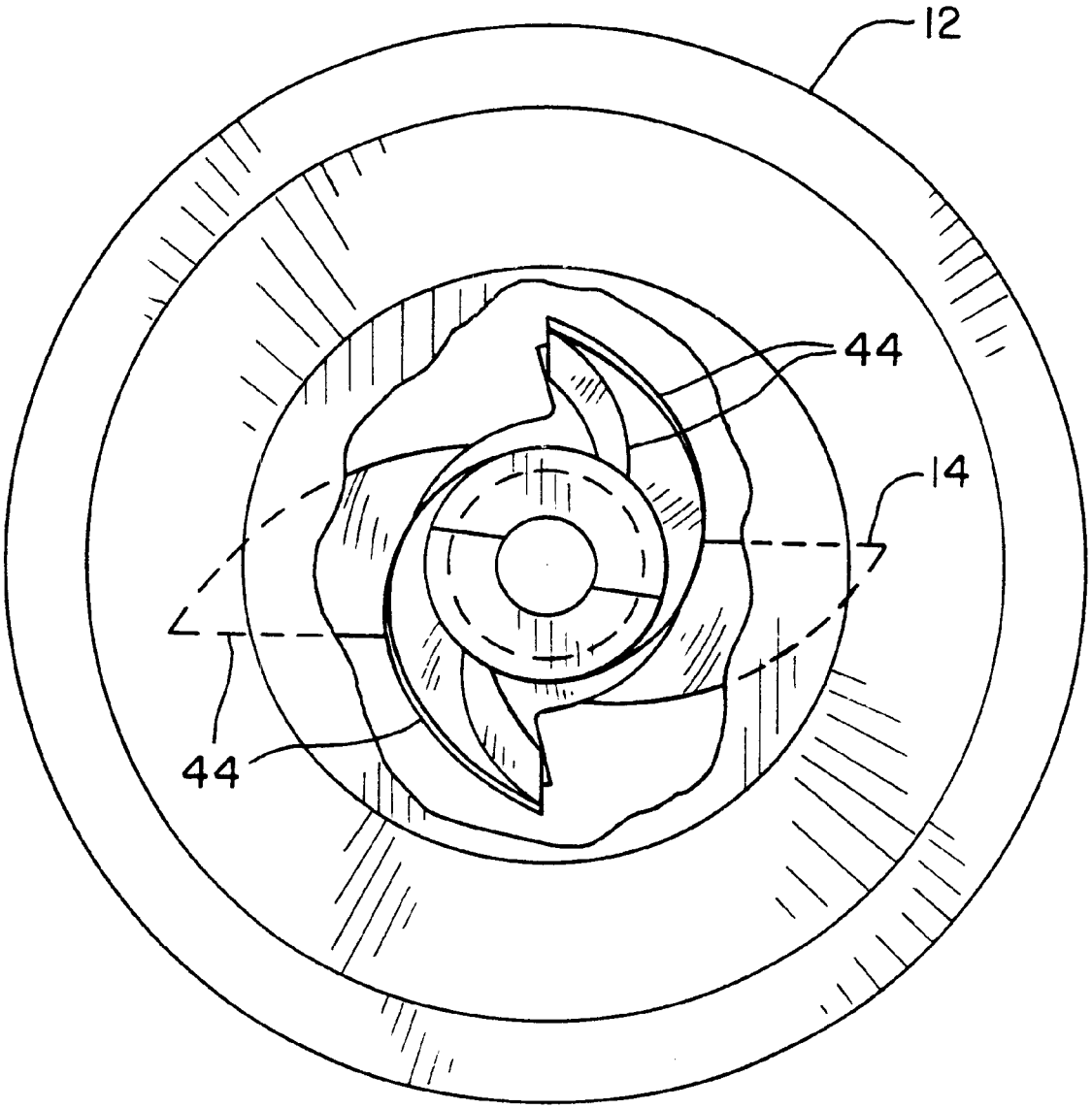
FIG. 2 of the pulper shown in FIG. 1.

Referring now to the drawings, and more particularly to FIGS. 1 and 2, there is shown an embodiment of a pulper 10 of the present invention for pulping a fiber source. Pulper 10 generally includes a tank 12 and a rotor 14.

Tank 12 has a plurality of annular-shaped inner walls 16, 18, 20 and 22 which define a chamber 24. More particularly, inner walls 16–22 are in the form of a first wall 16, second wall 18, third wall 20 and a forth wall 22 which sequintially vertically adjoin each other from a bottom to a top of chamber 24. Chamber 24 has a longitudinal axis 26, with each of first wall 16, second wall 18, third wall 20 and forth wall 22 being positioned generally concentric about axis 26. With the shape of inner walls 16–22 forming a part of the present invention, the exterior shape of tank 12 is not particularly important. Accordingly, only the shape of inner walls 16–22 are shown in the drawings for simplicity sake.

Each of inner walls 16–22 are positioned at an angle relative to an associated vertical reference 28 extending generally parallel with longitudinal axis 26. First wall 16, closest to the bottom of chamber 24, and is positioned at an angle $\beta$ ranging between 45–70°, more preferably between about 50–65°, and even more preferably ranges between about 55–60°. Second wall 18 is positioned at an angle $\alpha$ ranging between about 20–45°, preferably ranging between about 25–40°, and more preferably ranging between about 30–35° relative to a vertical reference 28. Third wall 20 is positioned generally parallel with longitudinal axis 26. Forth wall 22 is positioned at an angle $\gamma$ between about 10–30°, preferably ranging between about 15–25°, and more preferably ranging between about 17.5–22.5° relative to an associated vertical reference 28.

Figure 5:
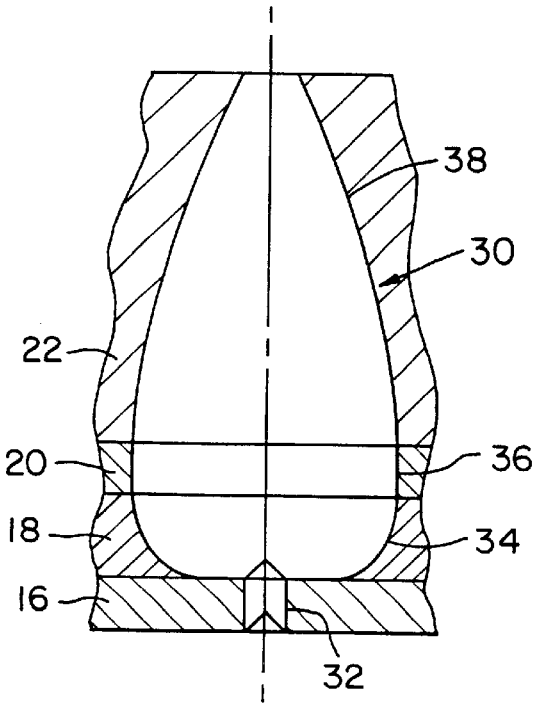
FIG. 5 is a view taken at line 5—5 in FIG. 1.
Figure 3:
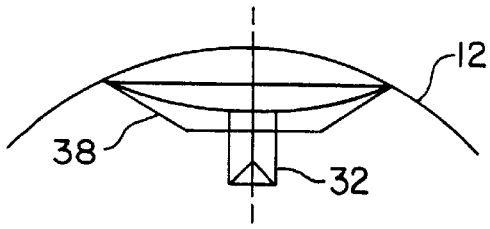
FIG. 3 is a fragmentary, sectional view taken at line 3—3 in FIG. 1.
Figure 4:
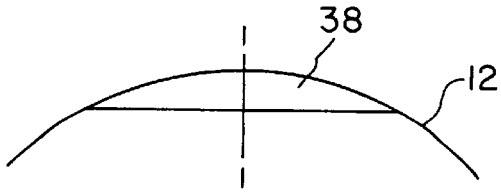
FIG. 4 is another fragmentary, sectional view taken at line 4—4 in FIG. 1.

Tank 12 also includes at least two baffles 30 which are configured and positioned within chamber 24 to inhibit rotational movement of the fiber source within chamber 24. More particularly, in the embodiment shown, two baffles 30 are provided within and on opposite sides of chamber 24. Each baffle 30 has a plurality of abutting generally planar faces which face towards longitudinal axis 26 of tank 12. That is, each baffle 30 is constructed with abutting segments which face towards longitudinal axis 26. When viewed along line 5—5 in FIG. 1, as shown in FIG. 5, each baffle 30 includes a lower, triangular shaped portion 32 adjacent first wall 16; a vertically adjacent eliptical portion 34 immediately adjacent second wall 18; a straight line portion immediately adjacent third wall 20; and a vertically adjacent eliptical portion 38 immediately adjacent forth wall 22. The shape of each baffle 30 as viewed along lines 3—3 and 4—4 in FIG. 1 are also shown in FIGS. 3 and 4, respectively. The shape of baffles 30, in combination with inner walls 16–22, has been found to provide improved high consistency pulping of a fiber source.

It has been found that the relative diameter and length ratios of the inner walls of tank 12 affect the output pulping through-put rate and quality. First wall 16 is assumed to have a relative inside diameter of 1 and a height of 1. Moreover, first wall 16 has an outside diameter ratio of about 1.4:1, preferably between about 1.25 to 1.55:1. Second wall 18 and third wall 20 each have an outside diameter ratio of between about 1.5 to 1.75:1, preferably about 1.65:1. Forth wall 22 has a diameter ratio at the top of tank 12 of between about 0.85 to 1.15:1, preferably about 0.95:1.

Moreover, in the embodiment shown, tank 12 has a height ratio at the top of second wall 18 of about 2.75:1 meters; a height ratio at the top of third wall 20 of about 3.5:1; and a height ratio at the top of forth wall 22 of between about 13 to 16:1, preferably about 14:1.

Figure 6:
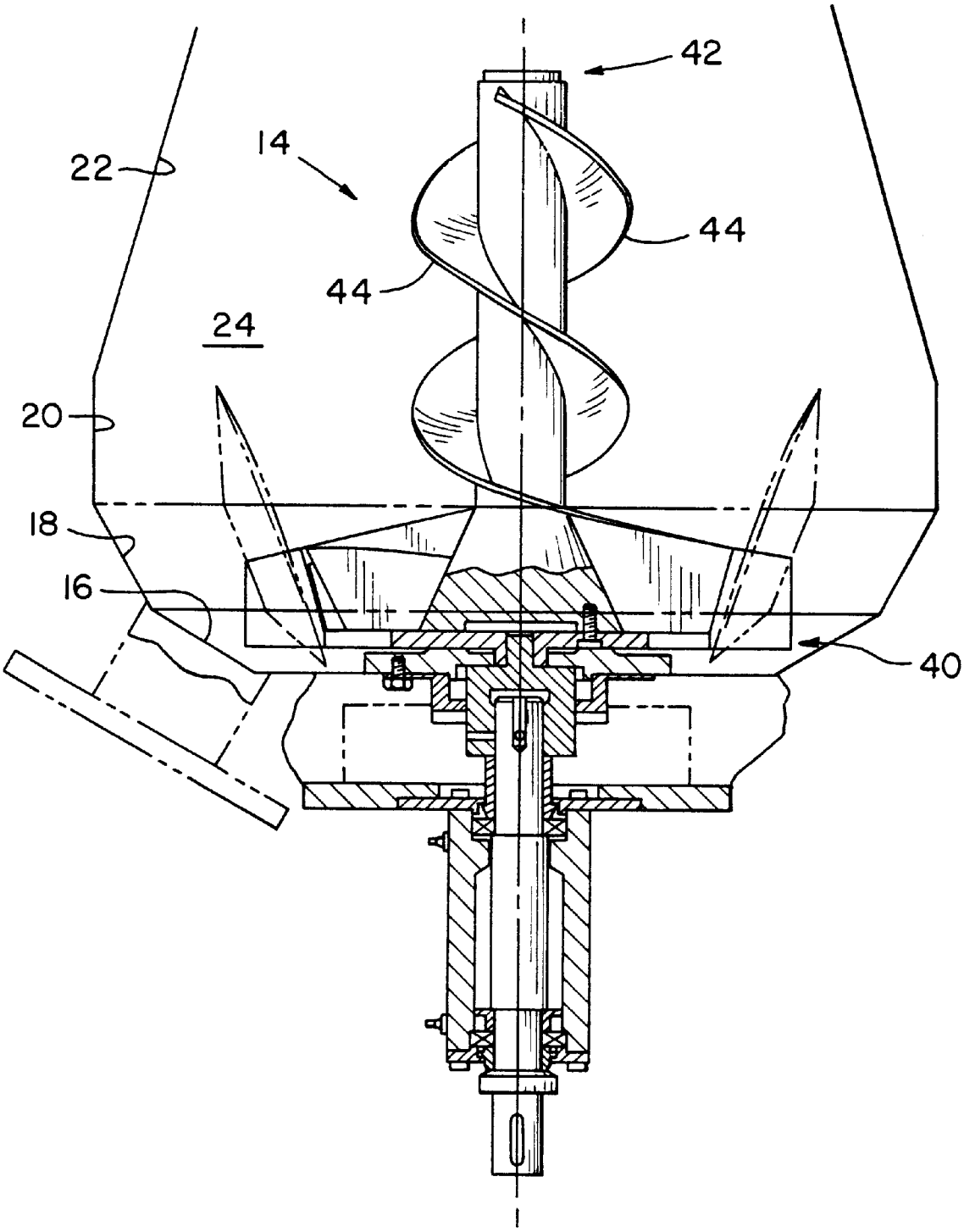
FIG. 6 is a side view of the rotor shown in FIG. 2 within the pulper tank.

Referring now to FIGS. 2 and 6 conjunctively, rotor 14 will be described in more detail hereinafter. Rotor 14 includes a bottom end 40 and an opposing top end 42. A pair of flightings 44 extend from bottom end 40 near the bottom of chamber 24 to top end 42. Each flighting 44 extends further radially outward near bottom end 40 to an area closely adjacent first wall 16. The portion of each flighting 44 extending further outward near the bottom end 40 of rotor 14 is configured to cause upward recirculation of the fiber source within chamber 24. For example, each flighting 44 may be configured with a pitch relative to the direction of rotation of rotor 14 which causes the fiber source to be recirculated within chamber 24. Of course, the exact pitch angle and/or number of flightings which are used on rotor 14 may vary, depending upon the particular application. Recirculation of the fiber source within chamber 24 results in a higher consistency stock which is outputted from pulper 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pulper for pulping a fiber source, comprising:

a tank having a plurality of annular-shaped inner walls defining a chamber, said plurality of walls including a first wall, second wall, third wall and fourth wall which are sequentially vertically adjoining relative to each other, each of said walls being disposed at an angle relative to a vertical reference, said first wall being disposed at an angle of between 45° and 70° relative to said vertical reference, said second wall being disposed at an angle of between 20° and 45° relative to said vertical reference, said third wall being disposed generally parallel to said vertical reference, and said fourth wall being disposed at an angle of between 10° and 30° relative to said vertical reference, said tank further including at least two baffles within said chamber for inhibiting rotational movement of the fiber source within said chamber; and a rotor disposed within said chamber.

2. The pulper of claim 1, said first wall being disposed at an angle of between 50° and 65° relative to said vertical reference.

3. The pulper of claim 2, said first wall being disposed at an angle of between 55° and 60° relative to said vertical reference.

4. The pulper of claim 1, said second wall being disposed at an angle of between 25° and 40° relative to said vertical reference.

5. The pulper of claim 4, said second wall being disposed at an angle of between 30° and 35° relative to said vertical reference.

6. The pulper of claim 1, said fourth wall being disposed at an angle of between 15° and 25° relative to said vertical reference.

7. The pulper of claim 6, said fourth wall being disposed at an angle of between 17.5° and 22.5° relative to said vertical reference.

8. The pulper of claim 1, said at least two baffles comprising two baffles positioned on opposite sides of said chamber.

9. The pulper of claim 1, said chamber having a longitudinal axis, each said baffle having a generally planar face which faces toward said axis.

10. The pulper of claim 1, said rotor having a bottom end and a plurality of flightings, at least one said flighting extending further radially outward near said bottom end for causing upward circulation of the fiber source within said chamber.

11. The pulper of claim 10, said at least one fliting including two flightings near said bottom end extending further radially outward.

12. A pulper for pulping a fiber source, comprising:

a tank having a plurality of annular-shaped inner walls defining a chamber having a longitudinal axis, said plurality of walls including a first wall, second wall, third wall and fourth wall which are sequentially vertically adjoining relative to each other, each of said walls being disposed at an angle relative to a vertical reference, said first wall being disposed at an angle of between 45° and 70° relative to said vertical reference, said second wall being disposed at an angle of between 20° and 45° relative to said vertical reference, and said fourth wall being disposed at an angle of between 10° and 30° relative to said vertical reference, said tank further including at least two baffles within said chamber for inhibiting rotational movement of the fiber source within said chamber, each said baffle having a generally planar face which faces toward said axis; and a rotor disposed within said chamber, said rotor having a bottom end and a plurality of flightings, at least one said flighting extending further radially outward near said bottom end for causing upward circulation of the fiber source within said chamber.

13. The pulper of claim 12, said first wall being disposed at an angle of between 50° and 65° relative to said vertical reference.

14. The pulper of claim 13, said first wall being disposed at an angle of between 55° and 60° relative to said vertical reference.

15. The pulper of claim 12, said second wall being disposed at an angle of between 25° and 40° relative to said vertical reference.

16. The pulper of claim 15, said second wall being disposed at an angle of between 30° and 35° relative to said vertical reference.

17. The pulper of claim 12, said fourth wall being disposed at an angle of between 15° and 25° relative to said vertical reference.

18. The pulper of claim 17, said fourth wall being disposed at an angle of between 17.5° and 22.5° relative to said vertical reference.

* * * * *

UNITED STATES PATENT AND TRADEMARK OFFICE

CERTIFICATE OF CORRECTION

PATENT NO. : 6,508,422 B2
DATED : January 21, 2003
INVENTOR(S) : Wickensberg et al.

It is certified that error appears in the above-identified patent and that said Letters Patent is hereby corrected as shown below:

Column 2,
Line 5, after "FIG. 1", insert -- is a plan --;
Line 7, after "FIG. 2", insert -- is a top view --; and
Line 12, after "FIG. 5 is a", insert -- sectional --.

Column 4,
Line 34, delete "flightings", and substitute therefor -- flitings --;
Line 34, delete "flighting", and substitute therefore -- fliting --;
Line 39, delete "flightings", and substitute therefore -- flitings --;
Line 61, delete "flightings", and substitute therefore, -- flitings --; and
Line 62, delete "flighting", and substitute therefore, -- fliting --.

Signed and Sealed this

Seventh Day of September, 2004

JON W. DUDAS
*Director of the United States Patent and Trademark Office*